US008888956B2

(12) United States Patent
Kraiter et al.

(10) Patent No.: US 8,888,956 B2
(45) Date of Patent: Nov. 18, 2014

(54) TREATED INORGANIC PIGMENTS HAVING IMPROVED BULK FLOW AND THEIR USE IN PAPER SLURRIES

(75) Inventors: Daniel C Kraiter, Wilmington, DE (US); Michael Patrick Diebold, Wilmington, DE (US); Timothy Allan Bell, Wilmington, DE (US)

(73) Assignee: E I du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 14/112,970

(22) PCT Filed: Apr. 24, 2012

(86) PCT No.: PCT/US2012/034793

§ 371 (c)(1),
(2), (4) Date: Oct. 21, 2013

(87) PCT Pub. No.: WO2012/148907

PCT Pub. Date: Nov. 1, 2012

(65) Prior Publication Data

US 2014/0034259 A1 Feb. 6, 2014

Related U.S. Application Data

(60) Provisional application No. 61/480,108, filed on Apr. 28, 2011.

(51) Int. Cl.
*D21H 11/00* (2006.01)

(52) U.S. Cl.
USPC ..... 162/164.6; 162/181.6; 524/388

(58) Field of Classification Search
USPC ..... 162/164.6, 181.6, 181.2, 191.3, 181.5, 162/181.8, 181.1; 524/388; 106/448
See application file for complete search history.

(56) References Cited

U.S. PATENT DOCUMENTS

| | | | |
|---|---|---|---|
| RE27,818 | E | 11/1973 | Werner |
| 4,125,412 | A | 11/1978 | West |
| RE30,233 | E | 3/1980 | Lane et al. |
| 4,239,548 | A | 12/1980 | Barnard et al. |
| 4,599,124 | A | 7/1986 | Kelly et al. |
| 4,689,102 | A | 8/1987 | Prawdzik et al. |
| 5,425,986 | A | 6/1995 | Guyette |
| 5,679,219 | A | 10/1997 | Harms et al. |
| 6,287,681 | B1 | 9/2001 | Mehta et al. |
| 6,290,815 | B1 | 9/2001 | Magnin et al. |
| 6,413,618 | B1 | 7/2002 | Parker et al. |
| 6,551,455 | B2 | 4/2003 | Johnson et al. |
| 6,706,372 | B2 | 3/2004 | Schulz et al. |
| 6,709,764 | B1 | 3/2004 | Perrin et al. |
| 6,761,979 | B2 | 7/2004 | Yokochi et al. |
| 6,783,631 | B2 | 8/2004 | Schulz |
| 8,623,507 | B2 | 1/2014 | Bell et al. |
| 2003/0138600 | A1 | 7/2003 | Dohring et al. |

FOREIGN PATENT DOCUMENTS

| | | |
|---|---|---|
| CA | 2765470 | 12/2010 |
| EP | 2067747 | 6/2009 |
| JP | 2194065 | 7/1990 |

OTHER PUBLICATIONS

EP International Search Report, PCT/US2012/034793. Dated Apr. 24, 2012.
The Pigment Handbook, vol. 1, 2nd Ed., John Wiley and Sons, NY, 1988 (Book Not Included).
Powders and Bulk Solids: Behavior, Characterization, Storage and Flow, Dietmar Schulze, 2007, Springer (Book Not Included).
Dr. Jerry Johanson, Jr Johanson Inc., Flow Indices in the Prediction of Powder Behavior, Pharmaceutical Manufacturing Intl, 1995, Published by Sterling Publications Ltd.
The Ceramic Waste Form Process at the Idaho National Laboratory, Stephen Priebe Egt Al., Aug. 2006, p. 14 of 16.
Indicizer Application Guide, Indices Definitions and General Flow Indications, Ver 1.20, pp. 1-5.

*Primary Examiner* — Mark Halpern

(57) ABSTRACT

The disclosure provides a paper slurry comprising a treated inorganic pigment, wherein the treated inorganic pigment comprises an inorganic pigment comprising a pigment surface area of about 30 to about 75 $m^2/g$; wherein the pigment surface is treated with an organic treating agent comprising a polyalkanol alkane or a polyalkanol amine, present in the amount of at least about 1.5%, and wherein the treated inorganic pigment has a RHI (rat hole index) of about 7 to about 11.

18 Claims, 1 Drawing Sheet

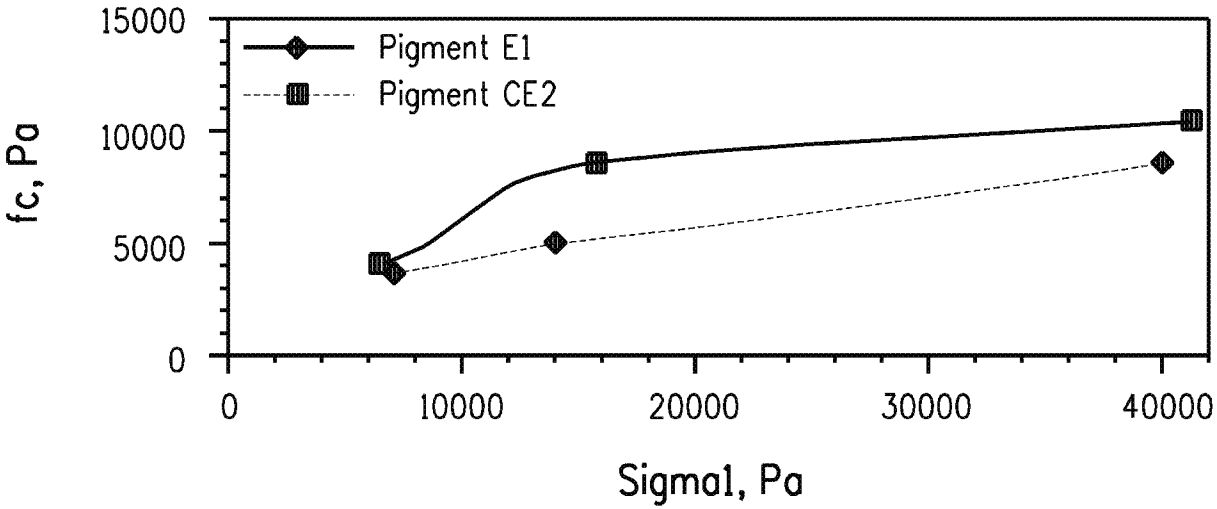
Pigment E1
Pigment CE2
15000
10000
5000
0
fc, Pa
0
10000
20000
30000
40000
Sigma1, Pa

TREATED INORGANIC PIGMENTS HAVING IMPROVED BULK FLOW AND THEIR USE IN PAPER SLURRIES

This application is a 371 of PCT/US2012/034793 filed 24 Apr. 2012

BACKGROUND OF THE DISCLOSURE

1. Field of the Disclosure

The present disclosure relates to treated inorganic pigments, more particularly treated titanium dioxide, having an improved bulk flow; a process for their preparation; and their use in paper slurries.

2. Description of the Related Art

Titanium dioxide pigments are used in many applications. One particular application demanding light fastness is the use in paper incorporated into paper laminates for decorative applications.

Paper laminates are in general well-known in the art, being suitable for a variety of uses including table and desk tops, countertops, wall panels, floor surfacing, tableware, outdoor applications, and the like.

Paper laminates have such a wide variety of uses because they can be made to be extremely durable, and can be also made to resemble (both in appearance and texture) a wide variety of construction materials, including wood, stone, marble and tile, and can be decorated to carry images and colors.

Typically, the paper laminates are made from papers by impregnating the papers with resins of various kinds, assembling several layers of one or more types of laminate papers, and consolidating the assembly into a unitary core structure while converting the resin to a cured state. The type of resin and laminate paper used, and composition of the final assembly, are generally dictated by the end use of the laminate.

Decorative paper laminates can be made by utilizing a decorated paper layer as upper paper layer in the unitary core structure. The remainder of the core structure typically comprises various support paper layers, and may include one or more highly-opaque intermediate layers between the decorative and support layers so that the appearance of the support layers does not adversely impact the appearance of decorative layer.

Paper laminates may be produced by both low- and high-pressure lamination processes.

Various methods can be employed to provide paper laminates by low-pressure lamination. For example, a single opening, quick cycle press can be used where one or more resin-saturated paper sheets are laminated to a sheet of plywood, particle board, or fiberboard. A "continuous laminator" can be used where one or more layers of the resin-saturated paper are pressed into a unitary structure as the layers move through continuous laminating equipment between plates, rollers or belts. Alternatively, a laminated sheet (continuous web or cut to size) may be pressed onto a particle or fiberboard, etc. and a "glue line" used to bond the laminated sheet to the board. Single or multiple opening presses may also be employed which contain several laminates.

In making paper laminates via high-pressure lamination, a plurality of sheets are impregnated with a thermosetting resin and stacked in superimposed relation, optionally with a decorative sheet placed on top. This assembly is then heat and pressure consolidated at pressures of at least about 500 psi. Generally, more than one laminate is formed at one time by inserting a plurality of sheet assemblies in a stack with each assembly being separated by a release medium which allows the individual laminates to be separated after heat and pressure consolidation. The laminates so formed are then bonded to a substrate, such as plywood, hardboard, particle board, fiberboard, composites and the like, by the use of adhesives such as contact adhesives, urea-formaldehyde, white glues (polyvinyl acetate emulsions), hot melts, phenolic or resorcinol formaldehyde, epoxy, coal tar, animal glues and the like.

It has been found desirable during the production of such laminates, by either low- or high-pressure lamination processes, to impart abrasion-resistant characteristics to the decorative surface portion of the laminate to enhance the utility of such laminates in end-use applications such as table and countertops, wall panels and floor surfacing. Such abrasion resistance can, for example, be imparted to paper laminates by means of an applied overlay sheet that provides a barrier over the print sheet. If the print sheet is decorative, the overlay should be substantially transparent. Abrasion-resistant resin coatings have also been applied to the surface of the laminate.

It has also been found desirable to impart moisture barrier properties to the base of such paper laminates, which can be done by bonding a moisture-barrier layer to the base of the laminate.

Examples of such paper laminates may be found, for example, in U.S. RE30233, U.S. Pat. Nos. 4,239,548, 4,599,124, 4,689,102, 5,425,986, 5,679,219, 6,287,681, 6,290,815, 6,413,618, 6,551,455 , 6,706,372, 6,709,764, 6,761,979, 6,783,631 and U.S.2003/0138600, the disclosures of which are incorporated by reference herein for all purposes as if fully set forth.

The papers in such paper laminates generally comprises a resin-impregnated, cellulose pulp-based sheet, with the pulp being based predominantly on hardwoods such as eucalyptus, sometimes in combination with minor amounts of softwood pulps. Pigments (such as titanium dioxide) and fillers are added in amounts generally up to and including about 45 wt % (based on the total dry weight prior to resin impregnation) to obtain the required opacity. Other additives such as wet-strength, retention, sizing (internal and surface) and fixing agents may also be added as required to achieve the desired end properties of the paper. Resins used to impregnate the papers include, for example, diallyl phthalates, epoxide resins, urea formaldehyde resins, urea-acrylic acid ester copolyesters, melamine formaldehyde resins, melamine phenol formaldehyde resins, phenol formaldehyde resins, poly (meth)acrylates and/or unsaturated polyester resins.

Examples of papers used in paper laminates may be found in U.S. Pat. No. 6,599,592 (the disclosure of which is incorporated by reference herein for all purposes as if fully set forth) and the above-incorporated references, including but not limited to U.S. Pat. Nos. 5,679,219, 6,706,372 and 6,783,631.

As indicated above, the paper typically comprises a number of components including, for example, various pigments, retention agents and wet-strength agents. The pigments, for example, impart desired properties such as opacity and whiteness to the final paper, and a commonly used pigment is titanium dioxide that is, in a relative sense, expensive in nature. Retention aids are added in order to minimize losses of titanium dioxide and other fine components during the papermaking process, which adds cost, as do the use of other additives such as wet-strength agents.

A need exists for an inorganic pigment such as titanium dioxide that has greater bulk density, improved flow characteristics and that is easier to handle in making paper slurries.

SUMMARY OF THE DISCLOSURE

In a first aspect, the disclosure provides a paper slurry comprising a treated inorganic pigment, wherein the treated inorganic pigment comprises an inorganic pigment, and in particular a titanium dioxide pigment, wherein the inorganic pigment, and in particular a titanium dioxide pigment, comprises a pigment surface area of about 30 to about 75 $m^2/g$; more typically about 40 to about 70 $m^2/g$; and still more typically about 45 to about 65 $m^2/g$, and most typically about 50 to about 60 $m^2/g$ wherein the pigment surface is treated with an organic treating agent comprising a polyalkanol alkane or a polyalkanol amine, present in the amount of at least about 1.5%, more typically at least about 1.8% and still more typically at least about 2%; wherein the treated inorganic pigment, and in particular titanium dioxide pigment, has a RHI (rathole index) of about 7 to about 11, more typically about 7 to about 10, and still more typically about 7 to about 9.

BRIEF DESCRIPTION OF THE DRAWINGS

FIG. 1 is a flow function graph that depicts the cohesive strength (fc) developed in response to compaction stress (Sigma1).

DETAILED DESCRIPTION OF THE DISCLOSURE

The disclosure relates to a process for treating an inorganic pigment, typically a titanium dioxide pigment, to form a pigment capable of being dispersed into a polymer melt, a paper slurry or a coating composition that can be used as a paint or an ink. The organic treatment in the treated pigment may be present in the amount of at least about 1.5 weight %, more typically in the amount of at least about 1.8 weight %, and most typically in the amount of at least about 2 weight %, based on the total weight of the treated pigment. Further, these treated pigments demonstrate improved flow characteristics, generally fewer lumps and have a RHI, rat hole index, of about 8 to about 11, more typically about 8 to about 10, and still more typically about 7 to about 9.

Treated Pigment:

It is contemplated that any inorganic pigment will benefit from the surface treatment of this disclosure. By inorganic pigment it is meant an inorganic particulate material that becomes uniformly dispersed throughout a polymer melt, a paper slurry, or coating resin and imparts color and opacity to the polymer melt, paper slurry, or coating resin. Some examples of inorganic pigments include but are not limited to ZnS, $TiO_2$, $CaCO_3$, $BaSO_4$, ZnO, $MoS_2$, silica, talc or clay.

In particular, titanium dioxide is an especially useful pigment in the processes and products of this disclosure. Titanium dioxide ($TiO_2$) pigment useful in the present disclosure may be in the rutile or anatase crystalline form. It is commonly made by either a chloride process or a sulfate process. In the chloride process, $TiCl_4$ is oxidized to $TiO_2$ pigments. In the sulfate process, sulfuric acid and ore containing titanium are dissolved, and the resulting solution goes through a series of steps to yield $TiO_2$. Both the sulfate and chloride processes are described in greater detail in "The Pigment Handbook", Vol. 1, 2nd Ed., John Wiley & Sons, NY (1988), the teachings of which are incorporated herein by reference. The pigment may be a pigment or nanoparticle.

By "pigment" it is meant that the titanium dioxide pigments have an average size of less than 1 micron. Typically, the pigments have an average size of from about 0.020 to about 0.95 microns, more typically, about 0.050 to about 0.75 microns and most typically about 0.075 to about 0.60 microns, as measured by Horiba LA300 Particle Size Analyzer The titanium dioxide pigment may be substantially pure titanium dioxide or may contain other metal oxides, such as silica, alumina, zirconia. Other metal oxides may become incorporated into the pigments, for example, by co-oxidizing or co-precipitating titanium compounds with other metal compounds. If co-oxidized or co-precipitated up to about 20 wt % of the other metal oxide, more typically, 0.5 to 5 wt %, most typically about 0.5 to about 1.5 wt % may be present, based on the total pigment weight.

The titanium dioxide pigment may also bear one or more metal oxide surface treatments. These treatments may be applied using techniques known by those skilled in the art. Examples of metal oxide treatments include silica, alumina, and zirconia among others. Such treatments may be present in an amount of about 0.1 to about 20 wt %, based on the total weight of the pigment, typically about 0.5 to about 12 wt %, more typically about 0.5 to about 3 wt %.

The inorganic pigment may have a surface area of about 30 to about 75 $m^2/g$; more typically about 40 to about 70 $m^2/g$; and still more typically about 45 to about 65 $m^2/g$, and still more typically about 50 to about 60 $m^2/g$.

The pigments of this disclosure may be treated with organic surface treatments such as a polyalkanol alkane or a polyalkanol amine. Some examples of polyalkanol alkanes include trimethylol-propane, trimethylolethane, glycerol, ethylene glycol, propylene glycol, 1,3 propanediol, pentaerythritol, etc. Some examples of polyalkanol amine include 2-amino-2-methyl-1-propanol, triethanol amine, monoethanol amine, diethanol amine, 1-amino 2-propanol, or 2-amino ethanol. The organic surface treatment are present in the amounts of at least about 1.5 weight %, more typically in the amount of at least about 1.8 weight %, and most typically in the amount of at least about 2 weight %, based on the total weight of the treated pigment. Amounts of organic surface treatment that are more than 10% may cause excessive dusting, color change and unnecessary dilution of the $TiO_2$.

Optionally, hydrous oxides are precipitated onto the base $TiO_2$ particles or $TiO_2$ particles that have been coated with inorganic particles. Such hydrous oxides are silica, alumina, zirconia, or the like. These may be added either before or after the addition of inorganic particles. If the hydrous oxides are added prior to addition of inorganic particles, then a filtering and washing step may be used prior to the addition of inorganic particles for colloidal suspensions that may be sensitive to flocculation. It is typical that the inorganic particles are added before the hydrous oxides are precipitated to further anchor the inorganic particles to the $TiO_2$ surface. For example, the method for precipitating the hydrous oxide is described in U.S. Pat. No. Re 27,818 and U.S. Pat. No. 4,125,412, the teachings of which are incorporated herein by reference. In precipitating the hydrous oxides, sodium silicate is added and neutralized with an acid such as HCl, $H_2SO_4$, $HNO_3$, $H_3PO_4$ or the like and then sodium aluminate is added and neutralized with acid. Other means of precipitated hydrous alumina are suitable, such as neutralization of aluminum sulfate or aluminum chloride using a base such as NaOH. The amount of hydrous oxide can vary from about 0 to about 16%, based on the total weight of the coated $TiO_2$ pigment. Typical amounts are about 0 to about 8 wt. % silica, more typically about 0 to about 4 wt. % silica, and about 0 to about 8 wt. % alumina, more typically about 0 to about 3 wt. % alumina. The order of addition is not particularly critical, however the hydrous alumina precipitation, if added, is the last preferred addition. The conventional finishing steps such as filtering, washing, drying and grinding are known and are subsequently carried out. The resulting product is dry, finished pigment that is useful for end use applications and/or can be used to prepare a slurry that is useful for end use applications.

After the inorganic wet treatment, the pigment is washed and filtered to remove salts. The process is done in a rotary filter or a filter press. The filter cake is then dried in a spray or flash drier and the drier discharge is de-agglomerated in a hammermill. The pigment is conveyed pneumatically to a fluid energy mill, e.g. micronizer where the final de-agglomeration step is done. The organic treatment can be done by spraying alkanol alkane or alkanol amine (neat or as an aqueous solution) at several locations: onto the filtercake before the hammermill, at the micronizer (main inlet, jet nozzle and/or main outlet). The addition can take place exclusively at one location or at more than one location, simultaneously.

Properties of the Treated $TiO_2$ Particle

While pigments are ultimately utilized for their ability to provide color or opacity to coatings or manufactured goods such as paper or plastic parts, the bulk handling properties of dry pigment prior to incorporation in a process are important.

The loose bulk density determines the size of package necessary to contain a specified mass of pigment, and pigments with excessively low bulk densities may not fill shipping containers (such as trucks) to their specified weight limits, resulting in increased transportation costs. At the consuming site, low bulk density pigments require larger storage vessels for the same mass, increasing capital costs. Screw feeders are commonly used in pigment processing, and their throughput is determined by pigment density. An existing feeder appropriate for one pigment may not be able to feed a second pigment with excessively low bulk density at the required rate. Certain processes for the incorporation of pigment into highly loaded polymer systems (master batching) utilize extruders or batch mixers (such as Banbury mixers) whose throughput capacity is limited by the volumetric displacement of the machine. A pigment with low bulk density does not fill such machines effectively, resulting in a reduction of pigment processing capacity.

The resistance of a dry pigment to flow by gravity will determine the type of equipment (silos, conveyors, and feeders) necessary for reliable storage and retrieval. Pigments with exceptionally poor flow properties may cause blockages in silos and handling systems intended for better-flowing powders. A pigment with superior flow properties can be expected to flow more reliably through existing equipment, and can reduce the investment necessary for new equipment by limiting the need for special features to promote flow. The accuracy of pigment dispensing (dosing) by loss-in-weight feeders will be enhanced by improved flowability, since the pigment will flow more uniformly through the equipment. Similarly, some mixing processes take place more readily if the pigment is readily dispersed (i.e, has little cohesion) when mixed amongst other ingredients.

Flowability in practice is determined by the quotient of pigment cohesive strength, which binds the particles together and impedes flow, and bulk density, which promotes flow under gravitational forces. The properties of cohesive strength and compacted bulk density must be measured under appropriate loading conditions. Using silo design theory (see *Powders and Bulk Solids: Behavior, Characterization, Storage and Flow*, by Dietmar Schulze, 2007 (English version), Springer, ISBN 978-3-540-73767-4) the silo outlet size necessary for reliable discharge by gravity can be calculated. This outlet size could be that required to prevent bridging (aka arching or doming) or ratholing (aka piping). Due to the nature of the flow patterns that are encountered in pigment handling, ratholing problems are dominant, so methods to predict the required size of outlet to prevent ratholing are most useful. Ratholing propensity otherwise known as rat-hole index (RHI) can be measured directly with the Johanson Hang-Up Indicizer (Johanson Innovations, San Luis Obispo, Calif.). The treated inorganic pigment, and in particular titanium dioxide pigment, has a RHI (rat hole index) of about 7 to about 11, more typically about 7 to about 10, and still more typically about 7 to about 9. Ratholing propensity can also be calculated from cohesive strength measurements made with shear cell devices such as the Jenike Shear Cell or the Schulze Ring Shear tester (both available from Jenike and Johanson, Inc, Tyngsboro, Mass.).

The treatment of the inorganic pigment of this disclosure not only helps the processability of solid particulates by lowering the particle surface energy, but also can increase bulk density, which is beneficial to pigment handling and packing. The level of organic treatment in order to achieve substantially uniform coverage of at least a monolayer around each pigment particle must be proportional to the pigment surface area. The higher the surface area, the higher the demand for the organic treatment.

The RHI for the treated pigment of this disclosure is notably low. The bulk density, is slightly higher than that of the untreated pigment. The RHI is proportional to the quotient of the cohesive strength divided by the bulk density, with both strength and density measured under specified levels of compaction stress:

$$RHI = \frac{\text{cohesive strength}}{\text{bulk density}} \times \text{constant}$$

Since for the treated pigment of this disclosure the RHI is appreciably lower, and bulk density is only slightly greater than the corresponding quantities for the untreated pigment, the cohesive strength must be significantly low. Measurement of the cohesive strength independent of the RHI measurement, showed an important difference between the treated pigment of this disclosure and the standard (untreated) pigment. Powders with low values of cohesive strength are often easier to feed accurately with screw feeders and also easier to mix in the dry state with other powders.

Paper Slurries

The present disclosure provides a titanium dioxide pigment for use in making paper laminates. In the process of making paper laminates, laminate papers are made which usually contain titanium dioxide as an agent to enhance paper opacity and brightness. The titanium dioxide may be first blended with water and the pH is controlled to form a slurry. This slurry may be then added to the blend of water and raw materials (pulp, pigments, chemicals, fillers, etc) on the paper machine which is eventually converted into dry paper.

In this disclosure, the titanium dioxide pigment may be treated with oxides of metals such as phosphorus or aluminum, etc. A source of phosphorus is typically phosphoric acid. However, the pigment can be treated with any suitable source of phosphorus such as salts of tetrapyrophosphate, salts of hexametaphosphate, and salts of tripolyphosphate. A source of aluminum is typically sodium aluminate. However, the pigment can be treated with any alternative suitable source of aluminum. The pigment surface treatment of the present disclosure may range in composition from about 2.0 to about 4% by weight P reported as $P_2O_5$ and about 4 to about 6% by weight Al reported as $Al_2O_3$. More typical is a composition from about 2.5 to about 3.2% by weight P reported as $P_2O_5$ and about 4.6 to about 5.4% by weight Al reported as $Al_2O_3$.

The pigment of this disclosure may comprise an isoelectric point from pH about 5.4 to about 6.7, and a zeta potential at pH=9.0 of less than about negative 40 mV, typically from about negative 40 mV to about negative 50 mV.

The pigment of this disclosure may be characterized by its light fastness in a laminate structure. Light fastness is the ability of the pigment, incorporated into a laminate, to resist significant color change upon prolonged exposure to ultraviolet light.

Pigment according to the present disclosure may be made as follows:

a. A slurry of titanium dioxide in water is prepared by mixing 4 parts titanium dioxide by weight on a dry basis and the pH of this slurry is adjusted to 7 using a base. A suitable base is sodium hydroxide. The amount of water in the slurry is not critical so long as it is fluid enough to provide good mixing as the treatment agents are added. For example, in a chloride titanium dioxide manufacturing process, oxidation reactor discharge slurry may be used as the slurry for treatment.

b. The slurry from step a. is heated to about 40° C.

c. At least one source of phosphorus and at least one source of aluminum are added to the heated slurry. Typically phosphoric acid and sodium aluminate are added. The source of phosphorus and source of aluminum can be added simultaneously. For example, materials for the treatment can be 2.05 parts of 85% by weight phosphoric acid, 6.66 parts of sodium aluminate solution at a concentration of 400 g per liter, and acid. A suitable acid is hydrochloric acid. Hydrochloric acid can be used at a concentration of from 10-40% percent by weight HCl. In one embodiment, the phosphoric acid and sodium aluminate are added simultaneously and at a rate to maintain the slurry pH at about 7 until all 2.05 parts of the phosphoric acid have been added to the slurry. Organic surface treatments of this disclosure are also added here. In another embodiment, at least a portion of the source of aluminum for reaction with the source of phosphorus is added first and the remaining source of aluminum and the acid are added at such rates that the pH of the slurry is maintained at 7. For example, at least a portion of the sodium aluminate aqueous solution for reaction with the phosphoric acid to form aluminum phosphate is added first and the remaining sodium aluminate solution (the remainder of the 6.66 parts) and the acid are added at such rates that the pH of the slurry is maintained at 7. Continue this addition until all 6.66 parts of the sodium aluminate has been added and the mixture is stirred for from 10 to 30 minutes.

The mixture is then dried and thermally treated as known to one skilled in the art.

Light fastness of a laminated panel constructed from décor paper is a highly desired property widely shared among laminate panel producers. Simply stated, light fastness refers to the resistance of a laminate panel to change color, or "photo-grey", upon prolonged exposure to light. Methods used to impart light fastness to a titanium dioxide pigment include both thermal and chemical treatments. Light stable pigment can exhibit improved light fastness corresponding to a decrease in delta E* (color change) of at least about 40% compared to non-treated pigment grades.

Using a thermal approach to light fastness, it is critical to maintain time at a specific minimum temperature to get the desired level of light fastness. The thermal treatment may be thus controlled by equipment such as a heated pneumatic conveyer, rotating kiln or any such environment that achieves the same effect known to one skilled in the art. In the context of the described invention, using a thermal route to light fastness would necessarily precede application of the organic treatment in order to avoid the temperatures and conditions that would likely promote the undesired combustion/oxidation of organic treatment, resulting in detrimental properties like pigment yellowing, in combination with destruction of the organic treating agent.

In addition to light fastness, it has also been found that the thermally treated pigments of this disclosure largely retain their brightness, as determined by comparing L* (a component of the widely used CIE L*a*b* color measurement system) of white laminates made with the treated and the untreated pigment.

The chemical route to light fastness has proven to be more economical compared to the described thermal process. Using this approach, wet filter cake can be treated by a variety of nitrate-containing inorganic salts, such as aluminum, sodium, or ammonium nitrate. Thus light fastness may be imparted at a point in the production process preceding or concurrent with application of the organic treatment, avoiding the necessary time penalty and energy costs associated with the heat-up and cool-down cycles of the thermal treatment approach.

The pigment from this process may typically be water dispersible requiring no addition other than pH adjustment in order to form stable slurries comprising up to 80% solids and exhibiting excellent light fastness according to methods used in assessing properties of decor papers and paper laminates. The method of making the decor papers or paper laminates is not critical in the performance of the pigment of the present disclosure.

In the typical high pressure laminates of the disclosure, the laminates are produced by pressing several impregnated layered papers. The structure of these molded laminated materials consists in general of a transparent layer (overlay) which produces an extremely high surface stability, a decorative paper impregnated with a synthetic resin and one or more kraft papers impregnated with a phenolic resin. Molded fiber board and particle board or plywood can be used as the substrate.

The decorative base paper contains a pigment mixture of the treated titanium dioxide pigment of this disclosure. The amount of titanium dioxide in the pigment mixture can be up to 55 wt. %, in particular from about 5 to about 50 wt. % or from 20 to about 45 wt. %, based on the weight of the paper. The pigment mixture may contain fillers such as zinc sulfide, calcium carbonate, kaolin or mixtures thereof.

Softwood pulp (long-fiber pulp) or hardwood pulp (short-fiber pulp) or a combination thereof may be used as the cellulose pulp for producing the decorative bulk paper.

Wet strength resins well known in the art of laminate papermaking may also be used.

The decorative bulk paper can be produced on typical equipment well known in the art of laminate papermaking by the high-pressure process.

The decorative base paper can be impregnated with the conventional synthetic resin dispersion, typically an aqueous dispersion of melamine-formaldehyde resin. The amount of resin introduced into the decorative base paper by impregnation can range from 25 to 30% based on the weight of the paper.

After drying the impregnated paper can also be coated and printed and then applied to a substrate such as a wooden board.

In the examples which follow, the descriptions of illustrative and typical embodiments of the present disclosure are not intended to limit the scope of the disclosure. Various modifications, alternative constructions and equivalents may be employed without departing from the true spirit and scope of the appended claims. In one embodiment, the coating films may be substantially free of other conventional colorants and contain solely the treated titanium dioxide pigments of this disclosure.

TEST METHODS

Loose Bulk Density (BD) Measurement:

Loose bulk density (BD) was measured as the most loosely packed bulk density when a material was left to settle by gravity alone. The loose bulk density utilized in these examples was measured using a Gilson Company sieve pan having a volume of 150.58 $cm^3$. The material was hand sieved through a 10 mesh sieve over the tared pan until overfilled. Excess product above the rim of the pan was then carefully removed using a large spatula blade at a 45° angle from horizontal, taking care not to jostle the contents of the pan. The pan was then weighed and the loose bulk density was then calculated by dividing the pigment weight in the pan by the volume of the pan. Each measurement was repeated 3 times and the average was reported.

Rathole Index (RHI) Measurement:

Using a Johanson Hang-Up Indicizer (Indicizer) from Johanson Innovations, Inc, the measured parameter know as rathole index (RHI), describes the degree of difficulty that can be expected in handling dry pigment in gravity flow situations, such as bins, hoppers, and feeders. The Indicizer compresses a known mass of pigment in a closed cell until the compaction stress corresponds to that expected in a bin or silo 10' in diameter. It then measures the volume of the compacted pigment and the force necessary to press a punch through the compacted pigment. From this data, the Indicizer's internal computer calculates the compacted bulk density and the stress necessary to shear the pigment at the specified compaction stress. From these parameters, the RHI index is generated. The RHI is a predictor of the size of bin outlet necessary to prevent ratholing, a typical flow obstruction occurring in pigment handling. Larger values of the RHI imply worse flow properties of the pigment. The units are linear, so that a pigment with a 50% higher RHI may require a 50% larger silo outlet in order to flow reliably by gravity.

Cohesive Strenath (Schulze Ring Shear) Test

The Schulze Ring Shear Tester, described in ASTM standard D 6773, is a device for measuring the resistance of a powder to shearing while it is confined under a specified level of compaction stress. It can also measure the volume and (and infer the bulk density) of the sample while conducting the test. Samples of pigment are loaded into a test cell, which is then weighed and placed in the tester. The computer controlled tester (Schulze RST-01-pc) then proceeds through a series of loadings and shearing actions to create a collection of shear data points. These points form a yield locus which is subsequently interpreted via Mohr circles to generate the unconfined yield strength (fc) corresponding to a particular level of compaction stress, known as the major principal stress. The unconfined yield strength is a descriptor of the ability of a compressed, cohesive powder to resist flow. Additional tests can be conducted under other stress levels to create additional yield loci, resulting in a graph (known as a flow function) of unconfined yield strength as a function of major principal stress. From such data, it is possible to compare the cohesiveness of two powders if they were to be subjected to prescribed loading conditions, or to compare their ratholing propensities.

Surface Area Measurement

The pigment surface area was measured using the 5 point nitrogen BET method using Micrometrics Tristar* 3000 Gas Adsorption Instrument and a Vac-Prep sample drying unit (Micrometrics Instrument Corp., Norcross, Ga.).

Carbon Content Measurement

Carbon analysis was performed on each dry particle sample using LECO CS 632 Analyzer (LECO Corp. St. Joseph, Mich.).

EXAMPLES

Example 1

A sample of rutile $TiO_2$ was treated with 10.2% silica and 6.4% alumina according to procedure described above. The treated pigment was filtered, washed and dried and 1500 g were added to a clean and dry, aluminum foil lined, metal pan. A solution of 50 wt % trimethylol propane (TMP) in Ethyl Alcohol was sprayed onto the pigment from a small, clean spray bottle. In order to ensure that the pigment surface was covered as uniformly as possible the pigment mass was mixed and turned over with a clean and dry metal spoon. TheTMP/Ethyl Alcohol solution addition was then repeated several times until a total of 60 grams of solution were added. The pan was placed in a ventilated hood and pigment was allowed to air dry for 48 hours. A V-cone blender was used to break up any chunks of the TMP treated pigment as follows: V-cone tumble+intensifier bar for 10 minutes followed by V-cone tumble only for 5 minutes.

The sample was dry milled in a 8" micronizer at a steam-to-pigment ratio (S/P) of 4 and a steam temp of 300° C. The product was tested for surface area, carbon content, rathole index, % residue on 10 mesh screen and bulk density with results shown in Table 1. The product was also tested for cohesive strength with results shown in FIG. 1.

Example 2

Example 1 was repeated with the following exceptions: 2000 g of this pigment were added to a clean and dry, aluminum foil lined, metal pan instead of 1500 g and treated with a total of 40 grams of theTMP/Ethyl Alcohol solution instead of 60 grams. The product was tested for surface area, carbon content, rathole index, % residue on 10 mesh screen and bulk density with results shown in Table 1.

Comparative Example 1

Example 2 was repeated with the following exceptions: No TMP/ethyl alcohol solution was added to the treated pigment and no drying, was therefore required. The product was tested for surface area, carbon content, rathole index, % residue on 10 mesh screen and bulk density with results shown in Table 1.

Comparative Example 2

A sample of commercial rutile $TiO_2$ having the following oxide treatment 10.2% silica and 6.4% alumina and no organic treatment, was tested for surface area, Carbon content, rathole index, % residue on 10 mesh screen and bulk density. Results are shown in Table 1. The product was also tested for cohesive strength with results shown in FIG. 1.

Example 3

Example 2 was repeated with the following exceptions: a total of 64 grams of TMP/ethyl alcohol solution were added. The product was tested for surface area, carbon content, rat-hole index, % residue on 10 mesh screen and bulk density with results shown in Table 1.

TABLE 1

| Sample | % TMP* | BET Surface Area ($m^2/g$) | RHI from Johanson Indicizer** | Screen on 10 mesh, soft lumps % | Loose Bulk Density (g/cc) |
|---|---|---|---|---|---|
| E1 | 1.90 | 56.4 | 8.35 | 1.0 | 0.3686 |
| E2 | 0.94 | 52.9 | 8.59 | 1.0 | 0.4088 |
| CE1 | 0.0 | 56.39 | 12.20 | 1.3 | 0.3084 |
| CE2 | 0.0 | 54.99 | 12.88 | 1.4 | 0.4051 |
| E3 | 1.58 | 59.1 | 7.18 | 4.2 | 0.3899 |

*calculated from Carbon content

**average of two independent measurements

Samples E1, E2, and E3 show substantially improved (ie, reduced) values of RHI versus the comparative examples CE1 and CE2. The loose bulk densities produced by the examples generally equal or exceed those measured for the comparative examples. It should be noted that sample CE2 experienced minimal handling in the testing and could expected to retain some previous consolidation (packing) and densification associated with its prior handling. The proportion of the pigment that was soft lumps is not noteworthy for tests conducted at this scale.

A Schulze Ring Shear Tester was used to measure the cohesive strength of two samples of pigment, the first tested as described in this disclosure (E1) and the second without the additional treatment (CE2). Results are shown in FIG. 1. At all levels of consolidation stress (Sigma 1), the treated pigment exhibited lower values of unconfined yield strength, fc.

Example 4

A slurry of the treated pigments described in Example 1 is prepared by mixing the pigments with water and adjusting the pH to 9.0-9.2. High-pressure laminate coupons are made from this treated pigment slurry. Laminate coupons are made by dipping 2"×7" strips of Whatman #1 filter paper into a resin bath containing a 50% aqueous solution of a standard melamine-formaldehyde resin and the appropriate amount of pigment slurry. This mixture may contain 9% $TiO_2$ pigment by weight, 45% water, and 45% melamine formaldehyde. Excess slurry on the surface of the dipped paper is wiped away with a plastic rod. The impregnated paper is air-dried for a minimum of 10 min and then heated in an oven for 7 minutes at 110° C. The laminate is constructed by placing the following substrates, listed from bottom to top, between two steel caul plates:

A) SINGLE OVERLAY SHEET
B) SINGLE WHITE BACKING SHEET
C) THREE SHEETS OF KRAFT PAPER
D) SINGLE WHITE BACKING SHEET
E) SIX PAIRS OF 2"×3" STRIPS IMPREGNATED WITH $TIO_2$ SLURRY (EACH PAIR STACKED ONE ON THE OTHER). ARRANGED SIDE-BY-SIDE IN 2×3 GRID.
F) SINGLE OVERLAY SHEET

The above "sandwich" is placed into a press heated to 300° F. and 36,000 psi pressure is applied for 6 min. After this period the press is cooled to below 115° F., the pressure is released, and the laminated paper sandwich is removed. This sandwich is cut into 6×2"×3" coupons, whose individual, initial L*a*b* colors are recorded. The coupons are next exposed to a temperature- and humidity-controlled light cabinet, like that produced by an Atlas model ci3000 Fade-ometer, Atlas Material Testing Company, Chicago, Ill., for 72 hrs. L*a*b* color is recorded for each coupon after removal, and the ΔE* value is calculated from the initial and final color measurements.

What is claimed is:

1. A paper slurry comprising paper pulp and a treated inorganic pigment, wherein the treated inorganic pigment is an inorganic pigment comprising a pigment with a surface area of about 30 to about 75 $m^2/g$; wherein the pigment surface is treated with an organic treating agent comprising a polyalkanol alkane or a polyalkanol amine, present in the amount of at least about 1.5%, based on the total weight of the treated inorganic pigment and wherein the treated inorganic pigment has a RHI (rat hole index) of about 7 to about 11.

2. The paper slurry of claim 1 wherein the inorganic pigment is ZnS, $TiO_2$, $CaCO_3$, $BaSO_4$, ZnO, $MoS_2$, silica, talc or clay.

3. The paper slurry of claim 1 wherein the pigment surface area is about 40 to about 70 $m^2/g$.

4. The paper slurry of claim 1 wherein the organic treating agent is a polyalkanol alkane.

5. The paper slurry of claim 4 wherein the polyalkanol alkane is trimethylolpropane, trimethylolethane, glycerol, ethylene glycol, propylene glycol, 1,3 propanediol, or pentaerythritol.

6. The paper slurry of claim 5 wherein the polyalkanol alkane is trimethylolpropane or trimethylolethane.

7. The paper slurry of claim 1 wherein the organic treating agent is a polyalkanol amine.

8. The paper slurry of claim 7 wherein the polyalkanol amine is 2-amino-2methyl-1-propanol, triethanol amine, monoethanol amine, diethanol amine, 1-amino 2-propanol, or 2-amino ethanol.

9. The paper slurry of claim 8 wherein the polyalkanol amine is 2-amino-2methyl-1-propanol or triethanol amine.

10. The paper slurry of claim 1 wherein the organic treating agent is present in the amount of at least about 1.8%, based on the total weight of the treated inorganic pigment.

11. The paper slurry of claim 1 further treated inorganic pigment is further treated with metal oxides.

12. The paper slurry of claim 11 wherein the metal oxide treatment comprises phosphorus, alumina, or mixtures thereof.

13. The paper slurry of claim 12 wherein the metal oxides are present in the amount of 0.1 to about 20 wt %, based on the total weight of the treated inorganic pigment.

14. A décor paper prepared from a a paper slurry, wherein the paper slurry comprises a treated inorganic pigment, wherein the treated inorganic pigment comprises an inorganic pigment comprising a pigment surface area of about 30 to about 75 $m^2/g$; wherein the pigment surface is treated with an organic treating agent comprising a polyalkanol alkane or a polyalkanol amine, present in the amount of at least about 1.5% based on the total weight of the treated inorganic pigment, and wherein the treated inorganic pigment has a RHI (rat hole index) of about 7 to about 11.

15. The décor paper of claim 14 further comprising a melamine formaldehyde resin.

16. A laminate comprising a décor paper prepared from a paper slurry, wherein the paper slurry comprises a treated inorganic pigment, wherein the treated inorganic pigment comprises an inorganic pigment comprising a pigment surface area of about 30 to about 75 $m^2/g$; wherein the pigment surface is treated with an organic treating agent comprising a polyalkanol alkane or a polyalkanol amine, present in the amount of at least about 1.5% based on the total weight of the treated inorganic pigment, and wherein the treated inorganic pigment has a RHI(rat hole index) of about 7 to about 11.

17. The laminate of claim 16 further comprising a Kraft paper core layer, a backing layer, and a melamine formaldehyde surface overlay.

18. A laminate of claim 17 comprising a $\Delta E^*$ value of 2.4 or less after 72 hrs exposure in the referenced light cabinet.

* * * * *